United States Patent [19]

Piskula

[11] Patent Number: 4,879,771

[45] Date of Patent: Nov. 14, 1989

[54] FLOOR CLEAN-OUT ASSEMBLY

[76] Inventor: James Piskula, P.O. Box 26174, Milwaukee, Wis. 53226

[21] Appl. No.: 161,800

[22] Filed: Feb. 29, 1988

[51] Int. Cl.[4] ..... E03F 5/04

[52] U.S. Cl. ..... 4/191; 4/255; 4/286; 285/42; 285/158

[58] Field of Search ..... 4/255, 286, 287, 288, 4/191; 285/42, 158, 160; 210/163, 164; 404/25, 26; 52/20, 21

[56] References Cited

U.S. PATENT DOCUMENTS

| | | | |
|---|---|---|---|
| 795,564 | 7/1905 | Turner | 285/160 |
| 1,017,813 | 2/1912 | Schuermann | 285/158 X |
| 1,766,621 | 6/1930 | Fleming | 210/165 |
| 1,792,345 | 2/1931 | Williams | 210/164 |
| 1,973,304 | 9/1934 | Boosey | 210/165 |
| 2,190,532 | 2/1940 | Lukomski | 210/164 |
| 2,490,075 | 12/1949 | Matheis | 210/165 |
| 2,501,971 | 3/1950 | Schenck | 210/165 X |
| 3,040,895 | 6/1962 | Sisk | 210/164 |
| 3,071,781 | 1/1963 | Seewack | 4/286 |
| 3,246,582 | 4/1966 | Wade et al. | 210/165 |
| 3,813,708 | 6/1974 | Hamburg | 4/286 |
| 3,896,511 | 7/1975 | Cuschera | 4/288 |
| 3,914,807 | 10/1975 | Palmer | 4/287 |
| 4,034,428 | 7/1977 | Jacuzzi | 4/287 |
| 4,067,072 | 1/1978 | Izzi | 4/288 |
| 4,146,939 | 4/1979 | Izzi | 4/286 |
| 4,207,632 | 6/1980 | Savell, Jr. et al. | 4/288 |
| 4,614,065 | 9/1986 | Papp | 404/26 X |
| 4,620,330 | 11/1986 | Izzi, Sr. | 4/288 |

OTHER PUBLICATIONS

Wade Division/Tyler Pipe Brochure (7/7/83).
Richmond Foundry and Manufacturing Co. Brochure (4/80).
Smith Brochure.
Josam Brochure.

*Primary Examiner*—Philip R. Coe
*Attorney, Agent, or Firm*—Quarles & Brady

[57] ABSTRACT

A floor clean-out assembly for a drain pipe comprises a tubular adapter having a top shaped to serve as the ball of a ball and socket and a bottom for connection to a drain pipe; and a tubular extension member for extending from the top of the adapter to a floor. The extension member has a bottom shaped to serve as a socket. When the top of the adapter is in the socket of the extension member, the extension member can be rotated so that its top is level with a floor. The adapter and extension member are preferably made of solvent weldable material so they can be readily welded in a desired position.

1 Claim, 2 Drawing Sheets

FLOOR CLEAN-OUT ASSEMBLY

FIELD OF THE INVENTION

The present invention relates to plumbing fittings. More particularly, it relates to an improved floor clean-out assembly for attachment to a drain pipe.

BACKGROUND OF THE INVENTION

The basement floors of buildings are usually provided with floor clean outs which provide access to sections of the drain pipe which for some reason cannot be conveniently cleaned from the floor drains. The usual floor clean-out assembly comprises a pipe which communicates at its lower end with a drain pipe; the other end or top of the pipe extends to the floor level and a cap or closure for the top of the pipe.

The drain pipes, drains and floor clean-outs are all put in place before a concrete floor is poured. However, in some instances, the pipes which communicate with the drain pipe are not perpendicular to the future floor or are not the right distance from the top of the proposed floor. In either or both of these cases, a plumber may have to spend considerable time and effort adjusting and improvising to make sure that the floor clean-out cap or closure will be level with and/or at the right height for the floor which is to be poured.

There is a need for a floor clean-out assembly which can be used to readily compensate for a pipe which is not perpendicular to the floor and/or which also can be adjusted vertically to adjust for different height floors.

BRIEF SUMMARY OF THE INVENTION

The primary objects of the present invention are to disclose a floor clean-out kit or assembly which can be used to readily compensate for a pipe which is not perpendicular to the floor and/or which also can be adjusted vertically to adapt to different floor heights.

The floor clean-out assembly of the present invention includes a generally cylindrical, tubular adapter which is sized and shaped at the bottom end for connection to the top of the pipe which leads to the drain. The top end of the adapter is rounded so it can serve as the ball of a ball and socket. The assembly also includes a tubular extension means which has an open top for receiving a closure or floorplate and a bottom which is concave so it can serve as a socket and cooperate with the rounded end of the adapter to permit leveling of the top of the extension member with the floor. The assembly further includes a floor plate for closing the open top of the extension member and a closure for closing the lumen of the adaptor at the rounded top end. The rounded end of the adaptor and the bottom of the extension means are preferrably of a solvent weldable material so that they can be easily welded together in the proper relationship with a solvent which may also be included in the kit.

In one embodiment, the extension means is comprised of two parts, one of which is a collar having a socket for the rounded top of the adapter and the other of which is a sleeve which has internal threads which mate with threads on the outside of the collar so that the sleeve can be adjusted vertically to the desired height for the proposed floor.

In another embodiment, the extension means is a single tubular member having a socket at the bottom and a floor plate receiving top. The extension means in this case is of a material which can be readily trimmed to the desired floor height.

Optionally, the assembly can also include a wrench for removing the closure in the adapter and one or more protective liners to protect the inside of the extension means and the adapter from damage by drain cleaning devices.

The aforementioned objects and other objects and advantages of the invention will become apparent to those skilled in the art from the description and drawings.

DESCRIPTION OF THE PREFERRED EMBODIMENT

Figure 1:
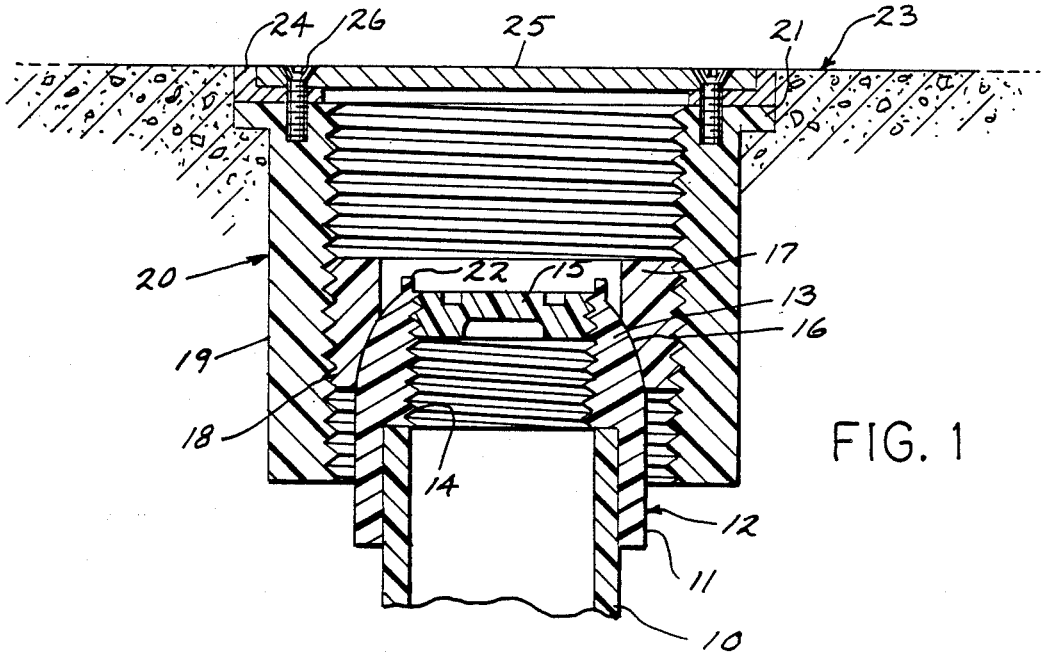
FIG. 1 is a vertical section of one embodiment of the floor clean-out assembly of the present invention showing it connected to a drain pipe which is perpendicular to the floor.
Figure 2:
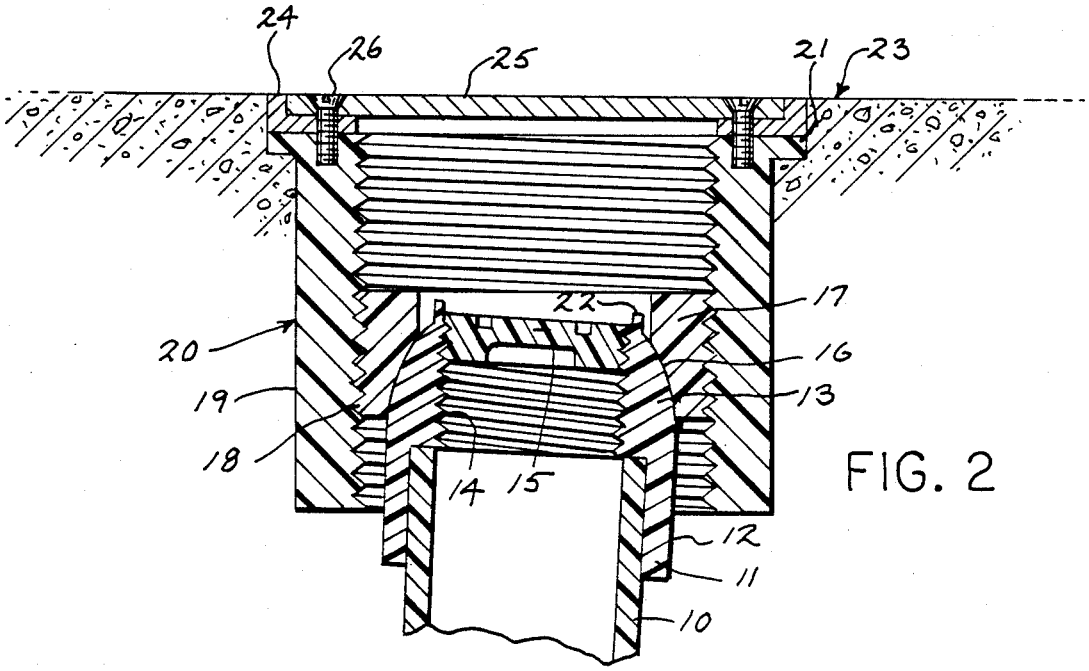
FIG. 2 is a view similar to FIG. 1 showing the floor clean-out assembly connected to a drain pipe which is not perpendicular to the floor.

Referring to FIGS. 1 and 2, there can be seen a vertical drain pipe 10 which is solvent welded or otherwise sealed to the bottom 11 of a tubular adapter 12. The top 13 of the adapter 12 is generally rounded and sized to function as the ball of a ball and socket. The lumen 14 of the adapter 12 is internally threaded at the top 13 and closed with a closure 15 having mating threads.

Still referring to FIGS. 1 and 2, it can be seen that the rounded top 13 of the adapter 12 is received in a socket 16 of a collar 17. The collar 17 has external threads 18 and is connected to the internally threaded bottom 19 of a sleeve 20. The top 21 of the sleeve 20 can be vertically raised or lowered by screwing the sleeve 20 up or down on the collar 17.

As seen in FIG. 1, the drain pipe 10 is perpendicular to floor 23 so that the top 21 of the sleeve 20 is parallel to the floor 23. The open top 21 is closed with a floor plate holder 24 and a floor plate 25, which as seen in the drawings, is secured in place by bolts 26. The collar 17 and sleeve 20 can be considered an "extension means" which extends between the rounded top 13 of the adapter 12 and the floor 23.

In FIG. 2 it can be seen that the drain pipe 10 is not perpendicular to the floor 23 as in FIG. 1. Therefore in order for the top 21 of the sleeve 20 to be level with the floor 23 the socket 16 has been rotated to the left on the rounded top 13 of the adapter 12. The rounded top 13 and the socket 16 are preferably both made of materials which are solvent weldable, such as polyvinyl chloride or ABS resins. As a result, the rounded top 13 and socket 16 can be locked in any desired position simply by coating the contacting surfaces of the top 13 and socket 16 with a suitable solvent material and permitting the top 13 and socket 16 to become welded together.

Figure 3:
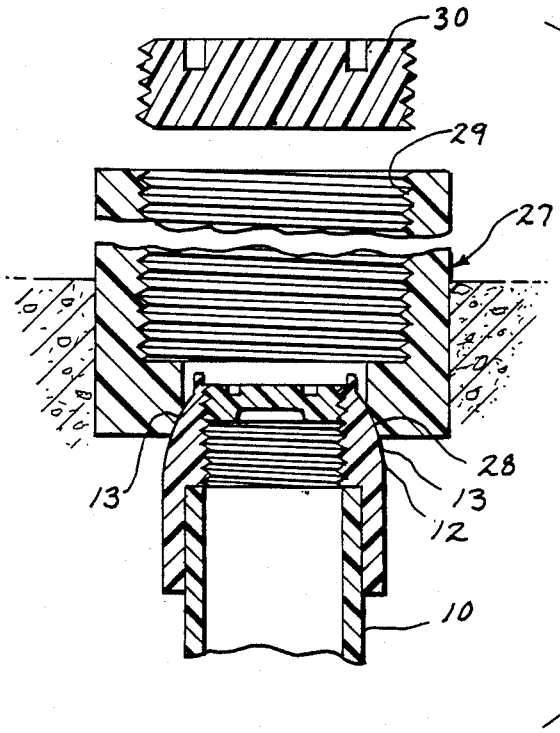
FIG. 3 is an exploded view showing a second embodiment of the floor clean-out assembly of the present invention.

In FIG. 3, a second embodiment is seen in which the extension means is a single tubular member 27 which has a ball receiving socket 28 at the bottom and a floor plate receiving top 29. When the embodiment of FIG. 3 is used, the plumber first levels the tubular member 27 to the floor 23 using the adapter top 13 and socket 28 as a ball and socket and then locks them in the desired position by solvent welding. The top 29 of the member 27 can be trimmed at the desired height either before or after the floor is poured and a floor plate or closure 30 for the open top screwed into place, completing the operation.

In both the embodiments of FIGS. 1 and 2 and FIG. 3, the rounded top 13 of the adapter 12 is provided with an annular ridge 22 which serves as a stop to prevent the socket and ball from being rotated to block access to the closure 15.

Figure 4:
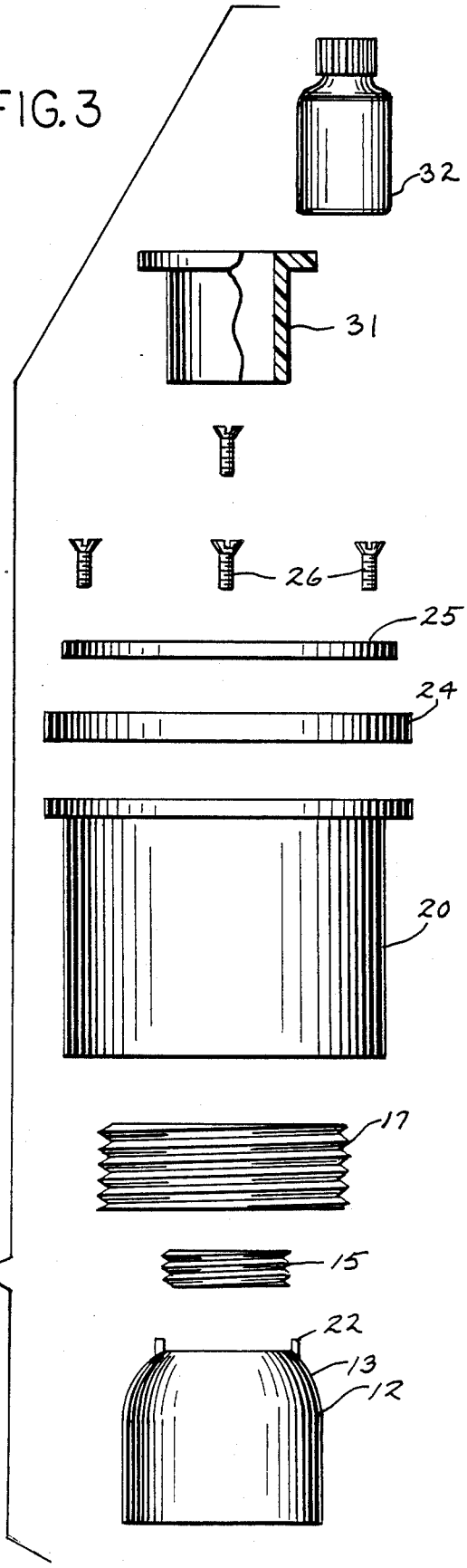
FIG. 4 is a perspective view of the components of a floor clean-out assembly kit of the present invention.

In FIG. 4 a kit is shown containing the components of the embodiment of FIGS. 1 and 2 which comprise the adapter 12, the closure 15 for the top of the adapter, the collar 17, the sleeve 20, the floor plate holder 24, the floor plate 25, the bolts 26, a protective liner 31 and a supply of solvent 32 for solvent welding.

It will be readily apparent to those skilled in the art that the floor clean-out of the present invention possesses significant advantages over the prior art devices because it can be both made level to a floor and adjusted to the desired height.

It also will be readily apparent to those skilled in the art that a number of further changes and modifications may be made without departing from the spirit and scope of the present invention. Therefore, it is intended that the invention not be limited except by the claims which follow.

I claim:

1. A floor clean-out assembly for a drain pipe comprising:

a tubular adapter having a central lumen extending therethrough, said adapter having a bottom for connection to a drain pipe and a top shaped to serve as the ball of a ball and socket; and, an extension means open at both ends and having a central lumen extending therethrough, said extension means having a socket adjacent one end for the top of the adapter and means at the other end to receive a floor plate to close said lumen, said extension means being comprised of a collar which has said socket at its bottom and a threaded exterior; and, a sleeve which has a threaded interior at one end which mates with the threaded exterior of the collar so that the sleeve can be turned and moved vertically along said collar to adjust the other end of the sleeve to the height of a floor.

* * * * *